US009303358B2

(12) United States Patent
Juhl et al.

(10) Patent No.: US 9,303,358 B2
(45) Date of Patent: Apr. 5, 2016

(54) WATER-DISINTEGRATABLE NON-WOVEN FIBROUS SHEET

(71) Applicant: Dow Global Technologies LLC, Midland, MI (US)

(72) Inventors: Hans-Juergen Juhl, Bad Fallingbostel (DE); Imad Qashou, Midland, MI (US); Anette Wagner, Walsrode (DE)

(73) Assignee: Dow Global Technologies LLC

( * ) Notice: Subject to any disclaimer, the term of this patent is extended or adjusted under 35 U.S.C. 154(b) by 28 days.

(21) Appl. No.: 14/359,316

(22) PCT Filed: Nov. 20, 2012

(86) PCT No.: PCT/US2012/066044

§ 371 (c)(1),
(2) Date: May 20, 2014

(87) PCT Pub. No.: WO2013/081911

PCT Pub. Date: Jun. 6, 2013

(65) Prior Publication Data

US 2014/0326423 A1 Nov. 6, 2014

Related U.S. Application Data

(60) Provisional application No. 61/564,906, filed on Nov. 30, 2011.

(51) Int. Cl.
*D21H 11/00* (2006.01)
*D21H 17/26* (2006.01)

(52) U.S. Cl.
CPC ..... *D21H 17/26* (2013.01); *D21H 11/00* (2013.01)

(58) Field of Classification Search
USPC ..... 162/177
See application file for complete search history.

(56) References Cited

U.S. PATENT DOCUMENTS

| | | | | |
|---|---|---|---|---|
| 3,485,651 | A * | 12/1969 | Granz | B01F 17/0028 106/162.82 |
| 5,281,306 | A | 1/1994 | Kakiuchi et al. | |
| 5,509,913 | A | 4/1996 | Yeo | |
| 6,670,521 | B2 | 12/2003 | Noda et al. | |
| 7,285,520 | B2 | 10/2007 | Krzysik et al. | |
| 7,838,725 | B2 | 11/2010 | Noda et al. | |
| 2001/0014566 | A1 * | 8/2001 | Kurata | A61F 13/15211 442/394 |

FOREIGN PATENT DOCUMENTS

| | | |
|---|---|---|
| EP | 0372388 | 6/1990 |
| EP | 0896089 | 2/1999 |
| GB | 2281081 | 2/1995 |

* cited by examiner

*Primary Examiner* — Jacob Thomas Minskey

(57) ABSTRACT

A water-disintegratable non-woven sheet comprising fibers bound by a water-soluble cellulose ether can be produced laying fibers to a base sheet, b) contacting the base sheet with a water-based composition comprising a water-soluble cellulose ether having a viscosity of up 500 mPa·s, measured as a 2 weight percent solution in water at 20° C. using a Haake Viscotester VT550 with a cylinder system, cup MV, at 2.55 $s^{-1}$, and c) drying the sheet which comprises fibers being bound by the water-soluble cellulose ether.

16 Claims, No Drawings

WATER-DISINTEGRATABLE NON-WOVEN FIBROUS SHEET

FIELD

The present invention relates to a water-disintegratable non-woven sheet, particularly a sheet which comprises fibers which are bound by a water-soluble binder.

INTRODUCTION

Water-disintegratable non-woven sheets are useful for a large variety of end-use applications. Excellent water-disintegratability is highly important for fibrous sheets that are used to cleanse human skin, such as fibrous sheets designated as toilet paper, or for fibrous sheets that are used to clean a toilet room. The fibrous sheets are often thrown away and drained in a toilet as is. If a fibrous sheet is not excellent in water-disintegratability, it requires a long time to be dispersed in a septic tank, and brings danger of clogging drainpipes of a toilet, when being thrown away and drained in a toilet.

Moreover, landfill solid waste disposal sites are rapidly filling to capacity. Significant contributions to the landfills are absorbent batting materials, particularly diapers, feminine hygiene products or incontinence products. These products typically contain non-biodegradable polyolefins that do not degrade rapidly when buried. Therefore, the problem of overloading landfill capacity could be helped significantly if batting products where flushable, and/or disintegratable and so could readily be recycled into the environment via a sewage system. Therefore, the skilled artisans have spent much research in producing water-disintegratable non-woven sheets which can either be used as monolayered sheets, such as cleaning cloths, or which can be used as a one of the layers in multilayered sheets, such as in table-napkins, table-cloths or cleaning cloths or in batting products, such as diapers, feminine hygiene products or incontinence products.

U.S. Pat. No. 6,670, 521 relates to a dispersible pre-moistened absorbent sheet product which essentially consists of a fibrous, mechanically weakened web to enhance the dispersibility in a standard toilet. A large variety of polymeric materials are suggested as a binder for the fibers. U.S. Pat. No. 7,838,725 discloses a dispersible absorbent product for hygiene purposes having a complex structure. It consists of at least two layers having mechanically weakened regions joined by a water responsive binder. The mechanical weakened regions enhance the dispersibility in a standard toilet. Unfortunately, the process of mechanically weakening the web or the layers significantly adds to the production costs of the product.

European Patent Application No. 0 896 089 discloses a water-disintegratable fibrous sheet which comprises fibers which are bound with a water-soluble binder that comprises polyvinyl alcohol and water-soluble carboxylate added to the sheet. Various sheets are produced that disintegrate within 40 to 330 seconds. The sheets have a good wet strength since the carboxylate serves as an electrolyte which has the function of salting out of polyvinylalcohol and increasing its strength. When the sheet is contacted with a large amount of water, the electrolyte is dissolved in water, thus the polyvinyl alcohol in a salting out state is also dissolved, and as a result, water-disintegratability is exhibited.

U.S. Pat. No. 5,509,913 discloses flushable compositions which comprise a temperature sensitive water soluble polymer in combination with a salt for altering the temperature at which the polymer is water soluble.

However, the necessity to include large salt concentrations in sheets which are designed to be disintegrated in water, e.g., by flushing them down in a conventional toilet, increases the salt load in the water, which is often undesirable. Also, large concentrations of some salts may cause skin irritations when particularly sensitive individuals are in contact with these sheets for a long time, for example in the case of diapers, feminine hygiene products or incontinence products.

UK Patent Application GB 2,281,081 discloses a fibrous web which is adapted to disintegrate in distilled water in 30 seconds or less when it is subjected to agitation. The web comprises a plurality of fibers and from 0.20 to 15 weight percent of a binder joining the fibers together. The binder comprises from 10 to 40 weight percent of a water dispersible polymer, from 10 to 40 weight percent of an elastomeric latex emulsion, from 20 to 40 weight percent of a xerogellant, and from 5 of 20 weight percent of a plasticizing agent. A fibrous web without a binder disintegrates within 10 seconds. The tensile force of an air-laid fibrous web without a binder is about 1.5 N, the tensile force of a wet-laid fibrous web without a binder is about 13 N. By incorporating the above-mentioned binder into the fibrous web, the tensile force of the fibrous web using air-led fibers can be increased to a range of 13-20 N; and the tensile force of the fibrous web using wet-led fibers can be increased to a range of 32-67 N. However, the fibrous web comprising the binder requires about 30 seconds for disintegration. Moreover, the binder requiring four different components including an elastomeric latex emulsion is relatively complex in its production.

Accordingly, one object of the present invention is to provide a new water-disintegratable non-woven sheet which disintegrates fast.

A preferred object of the present invention is to provide a new water-disintegratable non-woven sheet which comprises a binder that is capable of increasing the tensile force that the non-woven sheet withstands without breakage, however without unduly increasing the time required for disintegrating the non-woven sheet.

Surprisingly, it has been found that these objects can be achieved by binding fibers with a certain cellulose ether.

SUMMARY

Accordingly one aspect of the invention is a water-disintegratable non-woven sheet comprising fibers bound by a water-soluble cellulose ether which has a viscosity of up to 500 mPa·s, measured as a 2 weight percent solution in water at 20° C. using a Haake Viscotester VT550 with a cylinder system, cup MV, at 2.55 $s^{-1}$.

Another aspect of the invention is a process for producing the water-disintegratable non-woven sheet which comprises the steps of a) laying fibers to a base sheet, b) contacting the base sheet with a water-based composition comprising a water-soluble cellulose ether having a viscosity of up to 500 mPa·s, measured as a 2 weight percent solution in water at 20° C. using a Haake Viscotester VT550 with a cylinder system, cup MV, at 2.55 $s^{-1}$, and c) drying the sheet which comprises fibers being bound by the water-soluble cellulose ether.

DETAILED DESCRIPTION

The term "water-disintegratable" as used herein means that the non-woven sheet is divided in parts of 1 $cm^2$ or less upon contact with a large amount of water. Most preferably, the non-woven sheet disintegrates to such extent that the majority of the fibers are not bound by the water-soluble cellulose ether any more, which is visible as turbid suspension of fibers in water. A large amount of water means an amount that is at least 20 times, preferably at least 100 times the volume of the non-woven sheet.

Natural and/or chemical fibers can be used in the water-disintegratable non-woven sheet of the present invention. Examples of chemical organic fibers include a) rayon as an example of a regenerated fiber and b) polypropylene, polyvinyl alcohol, polyester, polyacrylonitrile, or synthetic pulp made from polyethylene as examples of synthetic fibers. Inorganic fibers, such as glass wool are also useful. Preferably natural fibers, such as cellulose fibers are used, more preferably wood pulp. The median length of the fibers typically is from 0.5 to 10 mm, more typically from 1 to 5 mm, and most typically from 1.5 to 2.5 mm Another essential component of the water-disintegratable non-woven sheet is a water-soluble cellulose ether having a viscosity of up to 500 mPa·s, preferably up to 400 mPa·s, more preferably up to 300 mPa·s, most preferably up to 200 mPa·s, and particularly up to 150 mPa·s, measured as a 2 weight percent solution in water at 20° C. using a Haake Viscotester VT550 with a cylinder system, cup MV, at 2.55 $s^{-1}$. The lower limit of the viscosity is not very critical. It is preferably at least 1.2 mPa·s, more preferably at least 2 mPa·s, most preferably at least 10 mPa·s, and particularly at least 20 mPa·s, when measured as described above. The cellulose ether is water-soluble, which means that it has a solubility in water of at least 1 gram, more preferably at least 2 grams, most preferably at least 5 grams in 100 grams of distilled water at 25° C. and 1 atmosphere. The water-disintegratable non-woven sheet may comprise one or more water-soluble cellulose ethers. In the case of two or more water-soluble cellulose ethers, the weight ranges stated below relates to the total weight of all cellulose ethers.

Preferred cellulose ethers are carboxy-$C_1$-$C_3$-alkyl celluloses, such as carboxymethyl celluloses; carboxy-$C_1$-$C_3$-alkyl hydroxy-$C_1$-$C_3$-alkyl celluloses, such as carboxymethyl hydroxyethyl celluloses; $C_1$-$C_3$-alkyl celluloses, such as methylcelluloses; $C_1$-$C_3$-alkyl hydroxy-$C_{1-3}$-alkyl celluloses, such as hydroxyethyl methylcelluloses, hydroxypropyl methylcelluloses or ethyl hydroxyethyl celluloses; hydroxy-$C_{1-3}$-alkyl celluloses, such as hydroxyethyl celluloses or hydroxypropyl celluloses; mixed hydroxy-$C_1$-$C_3$-alkyl celluloses, such as hydroxyethyl hydroxypropyl celluloses, or alkoxy hydroxyethyl hydroxypropyl celluloses, the alkoxy group being straight-chain or branched and containing 2 to 8 carbon atoms.

More preferred cellulose ethers are methylcellulose, hydroxypropyl methylcellulose, hydroxyethyl methylcellulose, hydroxyethyl ethylcellulose, hydroxypropyl cellulose, carboxymethyl cellulose and combinations of two or more of these cellulose ethers.

In one aspect of the invention, the water-soluble cellulose ether is a methyl hydroxy-$C_{1-3}$-alkyl cellulose, such as hydroxyethyl methylcelluloses or hydroxypropyl methylcelluloses. Such cellulose ether generally has an MS(hydroxyalkyl), particularly a MS(hydroxypropyl), of 0.05 to 1.00, preferably 0.07 to 0.80, more preferably 0.08 to 0.70, most preferably 0.10 to 0.60, and particularly 0.10 to 0.50. The degree of the hydroxyalkyl substitution, in the art also designated as "hydroxyalkoxyl substitution", is described by the MS(molar substitution). The MS(hydroxyalkyl) is the average number of hydroxyalkyl groups which are bound by an ether bond per mole of anhydroglucose unit. During the hydroxyalkylation, multiple substitutions can result in side chains. Such cellulose ether preferably has a DS(methyl) of from 1.2 to 2.2, more preferably from 1.25 to 2.10, and most preferably from 1.40 to 2.00. The degree of the methyl substitution, DS(methyl), in the art also designated as degree of the methoxyl substitution, DS(methoxyl), of a cellulose ether is the average number of OH groups substituted with methyl groups per anhydroglucose unit. For determining the DS(methyl), the term "OH groups substituted with methyl groups" does not only include the methylated OH groups at the polymer backbone, i.e., that are directly a part of the anhydroglucose unit, but also methylated OH groups that have been formed after hydroxyalkylation. The determination of the % methoxyl and % hydroxypropoxyl in hydroxypropyl methylcellulose is carried out according to the United States Pharmacopeia (USP 34). The values obtained are % methoxyl and % hydroxypropoxyl. These are subsequently converted into degree of substitution (DS) for methyl substituents and molar substitution (MS) for hydroxypropyl substituents. Residual amounts of salt have been taken into account in the conversion. The DS(methyl) and MS(hydroxyethyl) in hydroxyethyl methylcellulose is determined by Zeisel cleavage with hydrogen iodide followed by gas chromatography. (G. Bartelmus and R. Ketterer, Z. Anal. Chem. 286 (1977) 161-190).

In another aspect of the invention the water-soluble cellulose ether is a methylcellulose which preferably has a DS(methyl) of from 1.55 to 2.25, more preferably from 1.65 to 2.20, and most preferably from 1.70 to 2.10. The determination of the % methoxyl in methylcellulose is carried out according to the United States Pharmacopeia (USP 34). The values obtained are % methoxyl. These are subsequently converted into degree of substitution (DS) for methyl substituents. Residual amounts of salt have been taken into account in the conversion.

In yet another aspect of the invention the water-soluble cellulose ether is a carboxymethyl cellulose (CMC). Useful types of carboxymethyl cellulose (CMC) include their salts, preferably their sodium and potassium salts. The CMC is typically used in the form of its sodium salt. Preferred types of CMC have a DS of from 0.4 to 1.4, more preferably of from 0.6 to 1.0, and most preferably of from 0.7 to 0.9, measured according to ASTM D 1439-03 "Standard Test Methods for Sodium Carboxymethylcellulose; Degree of Etherification, Test Method B: Nonaqueous Titration".

In some embodiments, the water-disintegratable non-woven sheet may comprise one or more other components as optional additives, such as antistatic agents, flame retardants, heat stabilizers, impact modifiers, lubricants, processing aids, colorants, surfactants, dispersants, slip agents, or a combination thereof. These additives serve as agents facilitating the production of the water-disintegratable non-woven sheet or as modifiers depending on the specific properties which would be desirable to have in the final product.

The water-disintegratable non-woven sheet preferably comprises at least 0.5 weight percent, more preferably at least 1.0 weight percent, most preferably at least 2.0 weight percent, and in particular at least 3.5 weight percent of at least one water-soluble cellulose ether, based on the total weight of the non-woven sheet. The water-disintegratable non-woven sheet preferably comprises up to 50.0 weight percent, more preferably up to 40.0 weight percent, most preferably up to 30.0 weight percent, and in particular up to 25.0 weight percent of at least one water-soluble cellulose ether, based on the total weight of the non-woven sheet. The amount of the fibers is preferably up to 99.5 weight percent, more preferably up to 99.0 weight percent, most preferably up to 98.0 weight percent, and in particular up to 96.5 weight percent, based on the total weight of the non-woven sheet. The amount of the fibers is preferably up to 99.5 weight percent, more preferably up to 99.0 weight percent, most preferably up to 98.0 weight percent, and in particular up to 96.5 weight percent of the water-soluble cellulose ether, based on the total weight of the non-woven sheet. The water-disintegratable non-woven sheet preferably comprises from 0 to 20 weight percent, more preferably from 0 to 10 weight percent, and most preferably from 0 to 5 weight percent of one or more other components. In one aspect of the invention the water-disintegratable non-woven sheet consists of fibers bound by a water-soluble cellulose ether.

In embodiments of the invention, one or more of the above-described water-soluble cellulose ethers and optionally one or more other components are contacted with an aqueous diluent to produce a water-based composition. Water-soluble cellulose ethers are dissolved in the aqueous diluent in a known manner. Optional other components are dissolved or suspended in the aqueous diluent. As used herein, the term "aqueous diluent" includes water or water that is mixed with a minor amount of an alcohol. If an alcohol, such as methanol or ethanol, is mixed with water, the alcohol amount is typically not more than 30 percent, preferably not more than 15 percent, more preferably not more than 5 percent, based on the total weight of water and alcohol. Most preferably, only water is used as an aqueous diluent. The concentration of the water-soluble cellulose ether is generally at least 0.1 percent, preferably at least 0.2 percent, more preferably at least 0.5 percent, and most preferably at least 0.9 percent, based on the total weight of the water-based composition. If a high tensile strength of the water-disintegratable non-woven sheet is desired, in some embodiments higher concentrations of the water-soluble cellulose ether may be useful, such as 2.0 weight percent or more, or even 3.0 weight percent or more. The concentration of the water-soluble cellulose ether preferably is up to 15 percent, more preferably up to 10 percent, most preferably up to 8 percent, and in particular up to 6 percent, based on the total weight of the water-based composition. In one aspect of the invention the concentration of the water-soluble cellulose ether in the water-based composition is chosen such that the viscosity of the water-based composition is from 3 to 3,000 mPa·s, more preferably from 4 to 2,700 mPa·s, and most preferably from 6 to 2,500 mPa·s, measured using a Brookfield LVT viscometer at 25° C. Typically spindle No. 1 is used and the viscometer is run at 60 rpm (revolutions per minute). Depending on the viscosity, a different spindle no. and viscosity can be used as recommended by instruction the manual of the Brookfield LVT viscometer.

The fibers can be contacted with the water-based composition in a known manner. In one aspect, fibers can be suspended in the water-based composition. In another aspect of the invention, the fibers are laid to a base sheet, for example by any air laid, wet laid or carded process known in the art and the base sheet is contacted with the water-based composition in a known manner, e.g., by soaking the base sheet with the water-based composition or by spraying the water-based composition on the base sheet. The base weight of the sheet, i.e., the weight of the fibers without binder, is preferably from 20 to 250 g/m$^2$, more preferably from 40 to 200 g/m$^2$, and most preferably from 50 to 150 g/m$^2$. The resulting sheet which comprises fibers being bound by the water-soluble cellulose ether can be subsequently dried in a known manner.

The produced water-disintegratable non-woven sheet can be used as such as a monolayered sheet. Alternatively, two or more, typically 2 to 6, more typically 2 to 4 water-disintegratable non-woven sheets can be combined to produce a multilayered sheet. Typical examples of mono- or multilayered sheets are toilet paper, cleaning cloths, napkins, or table-napkins. Alternatively, the produced water-disintegratable non-woven sheet can be used in batting products, such as diapers, feminine hygiene products or incontinence products.

It is a beneficial feature of the non-woven sheet of the present invention that disposal of the sheet does not clause clogging of the flushing devices or disposal devices. This is particularly important in public lavatories that experience high levels of use and/or where easily cloggable flushing devices are used. Accordingly, a fast water-disintegratability of the non-woven sheet is essential. The water-disintegratable non-woven sheet of the present invention generally disintegrates in a time period of 20 seconds or less, typically in a time period of 15 seconds or less, when the non-woven sheet is stirred in water of 20 C. Depending on the type and amount of water-soluble cellulose ether that is used to bind the fibers, the non-woven sheet even disintegrates in a time of even 10 seconds or less, or even in a time period of 5 seconds or less. Typically it takes at least 1 second to disintegrate the non-woven sheet of the present invention.

It has surprisingly been found in the present invention that by selecting certain water-soluble cellulose ethers non-woven sheets can be produced which withstand quite high tensile forces before they break, for example by using a relatively high amount of the water-soluble cellulose ether in the sheet, but which still disintegrate in water within a very short time. For example, non-woven sheets can be produced that are disintegratable in water of 20° C. in a time period of 10 seconds or less, typically even in a time period of 5 seconds or less, and withstand a tensile force of at least 10 N, typically a tensile force of 10 N to 80 N, and more typically a tensile force of 15 N to 60 N, without breakage.

Some embodiments of the invention will now be described in detail in the following Examples.

EXAMPLES 1-11 AND COMPARATIVE EXAMPLES A TO J

Unless otherwise mentioned, all parts and percentages are by weight. In the Examples the following ingredients and test procedures are used.

Carboxymethyl Cellulose (CMC): The sodium salt of carboxymethyl cellulose is used which has a degree of carboxymethyl substitution per anhydroglucose unit (DS) of 0.9, measured according to ASTM D 1439-03 "Standard Test Methods for Sodium Carboxymethylcellulose; Degree of Etherification, Test Method B: Nonaqueous Titration". The CMCs have different viscosities, measured as a 2 weight percent solution in water at 20° C. using a Haake Viscotester VT550 with a cylinder system, cup MV, at 2.55 s$^{-1}$. The Haake Viskotester VT550 is commercially available from Thermo Electron, Germany.

All grades were used in powder form.

CMC-1: viscosity 60 mPa·s;
CMC-2: viscosity 114 mPa·s;
CMC-3: viscosity 565 mPa·s;
CMC-4: viscosity 8680 mPa·s;
CMC-5: viscosity 21040 mPa·s.

Hydroxypropyl Methylcellulose (HPMC): A hydroxypropyl methylcellulose is used which is commercially available under the trademark METHOCEL™ E50 from The Dow Chemical Company. It has a methoxyl content of 28-30%, a hydroxypropoxyl content of 7-12% and a viscosity of 48 mPa·s, measured as a 2 weight percent solution in water at 20° C. using a Haake Viscotester VT550 with a cylinder system, cup MV, at 2.55 s$^{-1}$.

Cotton Fiber: Cotton fibers are used which are commercially available under the trademark Arbocel FIF 400 from J.

RETTENMAIER & SOHNE, Germany. They have a fiber length of about 2000 pm and a fiber diameter of about 35 μm Preparation of the Non-woven Sheet A cellulose ether was dissolved in water in a known manner to prepare 70 g of an aqueous solution of the cellulose ether of the type and concentration listed in Table 1 below. 1 g of the cotton fibers were suspended in 70 g of this aqueous solution of cellulose ether. Excess solution was removed by applying vacuum using a suction filter. The formed sheet was dried at 70° C. using a cabinet dryer.

CEL™ E50 hydroxypropyl methylcellulose, are useful for producing water-disintegratable non-woven sheets which have an excellent water disintegratability and of which the tensile force that the non-woven sheet withstands without breakage can be tailor-made according to the particular needs in a given end-use application. Surprisingly, the tensile force that the non-woven sheet withstands without breakage can be increased without unduly increasing the time required for disintegrating the non-woven sheet. This is in contrast to the results obtained with the Comparative Examples.

TABLE 1

| | Aqueous solution of cellulose ether (CE) | | | | | Non-woven Sheet | |
|---|---|---|---|---|---|---|---|
| | | | | Solution | | | |
| (Comparative) Example | CE type | CE concentration [wt. %] | Spindle No. | Viscosity [mPa · s] | Disintegration Time [sec] | CE concentration [wt. %] | Tensile Force [N]* |
| 1 | CMC-1 | 1.0 | 1 | 11 | 2 | 3.1 | 1.4-1.8 |
| 2 | CMC-1 | 3.0 | 1 | 65 | 3 | 15.3 | 30.4-32.3 |
| 3 | CMC-1 | 5.0 | 2 | 408 | 4 | 22.3 | 52.8-55.8 |
| 4 | CMC-2 | 0.2 | 1 | 6 | 2 | 4.8 | 0.2-0.3 |
| 5 | CMC-2 | 0.5 | 1 | 11 | 2-3 | 5.9 | 1.2-1.3 |
| 6 | CMC-2 | 1.0 | 1 | 22 | 2 | 7.3 | 2.7-4.2 |
| 7 | CMC-2 | 3.0 | 2 | 325 | 2 | 12.4 | 17.9-29.6 |
| 8 | CMC-2 | 5.0 | 3 (30 rpm) | 2330 | 3 | 24.6 | 51.3-57.5 |
| A | CMC-3 | 0.2 | 1 | 10 | 9-10 | 5.2 | 0.8-1.0 |
| B | CMC-3 | 0.5 | 1 | 21 | >160 | 4.0 | 0.9-1.4 |
| C | CMC-3 | 1.0 | 1 | 72 | >1,200 | 9.2 | 10.1-13.0 |
| D | CMC-3 | 3.0 | 3 (30 rpm) | 2700 | >1,200 | 19.8 | 46.5-52.4 |
| E | CMC-4 | 0.2 | 1 | 28 | 5-7 | 4.9 | 0.7-1.1 |
| F | CMC-4 | 0.5 | 1 | 59 | >140 | 5.7 | 3.2-4.1 |
| G | CMC-4 | 1.0 | 2 (30 rpm) | 587 | >100 | 7.4 | 17.2-25.8 |
| H | CMC-5 | 0.2 | 1 | 67 | 6-13 | 3.7 | 0.7-1.0 |
| I | CMC-5 | 0.5 | 1 | 130 | >120 | 4.0 | 2.2-5.3 |
| J | CMC-5 | 1.0 | 3 (30 rpm) | 2020 | >1000 | 9.5 | 16.4-21.9 |
| 9 | METHOCEL ™ E50 | 1.0 | 1 | 5 | 4-5 | 5.0 | 1.1-1.5 |
| 10 | METHOCEL ™ E50 | 3.0 | 1 | 150 | 7-9 | 12.9 | 17.6-18.8 |
| 11 | METHOCEL ™ E50 | 5.0 | 2 | 1000 | 10-14 | 19.5 | 38.4 - 47.5 |

*Three measurements, lowest and highest values listed

Water-disintegratability:

200 ml water of 20° C. was placed into a beaker of 500 ml volume equipped with a magnetic stirrer. A nonwoven sample having the composition listed in Table 1 and having a size of 3cm×3 cm below was placed into the beaker. The water was stirred at 500 rpm. The time was measured until disintegration starts.

Tensile Force

A Texture Analyser TA.XT Plus was used. A 5 kg measuring cell was used for measuring tensile forces up to 52 N. Tensile Forces of more than 52 N were measured by using a 10 kg Measuring Cell. The testing Speed was 1mm/sec, the sample size was 3×5 cm. All samples were centered and fixed vertically by means of clamping jaws having a width of 35 mm The distance between the clamping jaws was 30 mm Solution Viscosity The viscosities of the aqueous solutions of the cellulose ether listed in Table 1 below were measured using a Brookfield LVT viscometer at 25° C. The used spindle size is listed in Table 1. Unless otherwise mentioned in Table 1, the rotational speed of the viscometer was 60 rpm (revolutions per minute). Depending on the viscosity, a different spindle no. and viscosity can be used as recommended by the instruction manual of the Brookfield LVT viscometer.

The results in Table 1 below illustrate that water-soluble cellulose ethers having a viscosity of up to 500 mPa·s, measured as a 2 weight percent solution in water at 20° C. using a Haake Viscotester VT550 with a cylinder system, cup MV, at 2.55 $s^{-1}$, exemplified by CMC-1, CMC-2 and METHO-

The invention claimed is:

1. A water-disintegratable non-woven sheet comprising fibers bound by a water-soluble cellulose ether having a viscosity of up to 500 mPa·s, measured as a 2 weight percent solution in water at 20° C. using a Haake Viscotester VT550 with a cylinder system, cup MV, at 2.55 $s^{-1}$, wherein the water-disintegratable non-woven sheet comprises from 3.5 to 50.0 weight percent of the water-soluble cellulose ether, from 50.0 to 96.5 weight percent of fibers and from 0 to 5 weight percent of one or more other components, based on the total weight of the non-woven sheet.

2. The sheet of claim 1 wherein the water-soluble cellulose ether has a viscosity of up to 300 mPa·s, measured as a 2 weight percent aqueous solution at 20° C.

3. The sheet of claim 1 wherein the water-soluble cellulose ether is a carboxymethyl cellulose.

4. The sheet of claim 1 wherein the amount of the water-soluble cellulose ether is from 3.5 to 30 weight percent, based on the total dry weight of the sheet.

5. The sheet of claim 1, wherein the fibers are cellulose fibers.

6. The sheet of claim 1, wherein the sheet is disintegratable in water of 20° C. in 10 seconds or less.

7. The sheet of claim 1, wherein the sheet withstands a tensile force of at least 10 N without breakage.

8. A multilayered sheet wherein at least one of the layers is a water-disintegratable non-woven sheet of claim 1.

9. A process for producing the water-disintegratable non-woven sheet of claim 1 comprising the steps of a) laying fibers to a base sheet, b) contacting the base sheet with a water-based composition comprising a water-soluble cellulose ether having a viscosity of up to 500 mPa·s, measured as a 2 weight percent solution in water at 20° C. using a Haake Viscotester VT550 with a cylinder system, cup MV, at 2.55 $s^{-1}$, and c) drying the sheet which comprises fibers being bound by the water-soluble cellulose ether, wherein the fibers and the water-based composition comprising the water-soluble cellulose ether are contacted as such amounts that upon drying the water-disintegratable non-woven sheet comprises from 3.5 to 50.0 weight percent of the water-soluble cellulose ether, from 50.0 to 96.5 weight percent of fibers and from 0 to 5 weight percent of one or more other components, based on the total weight of the non-woven sheet.

10. The process of claim 9 wherein the produced water-disintegratable non-woven sheet is combined with one or more additional layers.

11. The sheet of claim 3 wherein the fibers are cellulose fibers.

12. The process or claim 9 wherein the water-soluble cellulose ether is a carboxymethyl cellulose.

13. The process or claim 9 wherein the fibers are cellulose fibers.

14. The process or claim 12 wherein the fibers are cellulose fibers.

15. The sheet of claim 1 comprising the water-soluble cellulose ether having a viscosity of up to 300 mPa·s, measured as a 2 weight percent aqueous solution at 20° C., at an amount that the sheet withstands a tensile force of at least 10 N without breakage and is disintegratable in water of 20° C. in 10 seconds or less.

16. The process of claim 9 wherein the water-soluble cellulose ether has a viscosity of up to 300 mPa·s, measured as a 2 weight percent aqueous solution at 20° C., and the fibers and the water-based composition comprising the water-soluble cellulose ether are contacted as such amounts that upon drying the water-disintegratable non-woven sheet the sheet withstands a tensile force of at least 10 N without breakage and is disintegratable in water of 20° C. in 10 seconds or less.

* * * * *